US008651449B2

(12) United States Patent
Au

(10) Patent No.: US 8,651,449 B2
(45) Date of Patent: Feb. 18, 2014

(54) CONCRETE FORMING PANEL

(75) Inventor: Clarence Pang Au, Markham (CA)

(73) Assignee: Brand Services, LLC, Kennesaw, GA (US)

( * ) Notice: Subject to any disclaimer, the term of this patent is extended or adjusted under 35 U.S.C. 154(b) by 0 days.

(21) Appl. No.: 13/377,032

(22) PCT Filed: Jun. 7, 2010

(86) PCT No.: PCT/CA2010/000860

§ 371 (c)(1),
(2), (4) Date: Jan. 13, 2012

(87) PCT Pub. No.: WO2010/142023

PCT Pub. Date: Dec. 16, 2010

(65) Prior Publication Data

US 2012/0119061 A1 May 17, 2012

(30) Foreign Application Priority Data

Jun. 11, 2009 (CA) ..... 2668598

(51) Int. Cl.
*E04G 9/00* (2006.01)
*E04G 11/00* (2006.01)
*E04G 17/00* (2006.01)

(52) U.S. Cl.
USPC ..... 249/47; 249/139; 249/163; 249/168; 249/170; 249/189; 249/195

(58) Field of Classification Search
USPC ..... 249/47, 139, 160, 163, 168–171, 189, 249/195
See application file for complete search history.

(56) References Cited

U.S. PATENT DOCUMENTS 1,426,374 A * 8/1922 Garlinghouse ..... 249/189
1,533,960 A * 4/1925 Wells ..... 249/196
2,845,685 A * 8/1958 Lovgren et al. ..... 249/192
4,470,647 A * 9/1984 Bishoff et al. ..... 312/111

(Continued)

FOREIGN PATENT DOCUMENTS

CA 2141463 8/1996
DE 3804506 A1 * 8/1989 ..... E04G 9/05

(Continued)

OTHER PUBLICATIONS

Translation of FR 2717848 (date is not applicable).*

(Continued)

*Primary Examiner* — Dimple Bodawala
(74) *Attorney, Agent, or Firm* — Greensfelder, Hemker & Gale, P.C.; Peter S. Gilster

(57) ABSTRACT

Concrete forming panels according to the present invention are formed using a series of interlocking panel sections mechanically connected at a forward face of the panel. The mechanical connection uses a hook portion of one section received in a slot portion of an adjacent section with a pivot and stop relation defining the planar forming face. A series of brace members extend across the panel sections on a rear surface and maintain engagement of the panel sections and reinforce the panel sections against deformation of the forming face during use of the panel. The arrangement is economical to manufacture in many different sizes as may be required by a customer. Some welding is used, however the mechanical connection greatly reduces the amount of welding required. Replacement sections can easily be used to repair damaged panels.

11 Claims, 3 Drawing Sheets

(56) References Cited

U.S. PATENT DOCUMENTS

| | | | | | |
|---|---|---|---|---|---|
| 5,102,092 | A * | 4/1992 | Salas | 249/192 |
| 5,160,640 | A * | 11/1992 | Badstieber | 249/189 |
| 5,372,349 | A * | 12/1994 | Elmore | 249/112 |
| 5,649,401 | A * | 7/1997 | Harrington, Jr. | 52/426 |
| 5,683,609 | A * | 11/1997 | Schworer | 249/18 |
| 5,740,648 | A * | 4/1998 | Piccone | 52/426 |
| 5,833,873 | A * | 11/1998 | Adonetti | 249/47 |
| 6,167,669 | B1 * | 1/2001 | Lanc | 52/426 |
| 6,283,439 | B1 * | 9/2001 | Myers et al. | 249/45 |
| 6,581,898 | B2 * | 6/2003 | McCracken | 249/189 |
| 6,694,692 | B2 * | 2/2004 | Piccone | 52/426 |
| 7,011,782 | B2 * | 3/2006 | Smith | 264/297.9 |
| 2005/0016103 | A1 * | 1/2005 | Piccone | 52/481.1 |
| 2006/0213140 | A1 * | 9/2006 | Morin et al. | 52/426 |
| 2009/0146043 | A1 * | 6/2009 | Gates | 249/103 |
| 2010/0251657 | A1 * | 10/2010 | Richardson et al. | 52/588.1 |
| 2012/0223212 | A1 * | 9/2012 | Schneider et al. | 249/187.1 |

FOREIGN PATENT DOCUMENTS

| | | | | |
|---|---|---|---|---|
| DE | 4122173 | A1 * | 1/1993 | E04G 9/02 |
| DE | 19627121 | A1 * | 1/1998 | F16S 1/00 |
| EP | 399114 | A1 * | 11/1990 | E04G 9/05 |
| EP | 2090718 | A2 * | 8/2009 | E04G 9/06 |
| FR | 2717848 | A1 * | 3/1994 | E04G 11/06 |
| JP | 06158849 | A * | 6/1994 | E04G 9/00 |
| WO | WO 9525864 | A1 * | 9/1995 | E04H 4/00 |
| WO | WO 0163066 | A1 * | 8/2001 | E04G 9/00 |
| WO | WO 2005021892 | A1 * | 3/2005 | E04G 9/05 |

OTHER PUBLICATIONS

Translation of EP 2090718 (date is not applicable).*

International Search Report and Written Opinion issued on Sep. 23, 2010, in related application No. PCT/CA2010/000860.

Canadian Patent Office, Notice of Allowance issued on Nov. 21, 2011, in related Canadian application No. 2668598.

* cited by examiner

CONCRETE FORMING PANEL

FIELD OF THE INVENTION

The present invention relates to concrete forming panels, and in particular, relates to concrete forming panels having a series of interlocking panel sections mechanically secured to adjacent panel sections.

BACKGROUND OF THE INVENTION

Concrete forming panels are commonly used in the construction industry to quickly assemble a concrete form. Forming panels have been used for many years, and often have a plywood concrete engaging face with a reinforcing structure secured on a rear side thereof to support the concrete load.

It is also known to use a concrete forming panel fabricated from aluminum extrusions where these extrusions are mechanically connected to define the forming panel. One such example of this structure is illustrated in Canadian Patent 2,141,463 that is owned by the present applicant. In this reference, the concrete forming panel is broken into a number of panel sections where each section is an aluminum extrusion. The aluminum extrusions are connected to an adjacent extrusion by a hook and slot arrangement, and by a curved flange provided adjacent a rear edge beneath the hook and slot arrangement. This curved flange is connected to a structural member of the adjacent panel section to mechanically secure the two sections together and to maintain a predetermined angle of the forward face of each of these panels. With this arrangement, a reinforced box-like structure is provided beneath the mechanical securement (hook and slot) of the two panels at the forward face.

With the structure as disclosed in Canadian Patent 2,141,463 the connected panel sections required additional support and the panel sections were prone to deflection at intermediary positions, even if the rear face of the panel was supported.

It would be desirable to provide a concrete forming panel having the desirable characteristic of being assembled from a series of extrusions while providing a panel that is easy to assemble and is relatively stiff.

SUMMARY OF THE INVENTION

A concrete forming panel according to the present invention comprises at least first and second interlocking panel sections having a mechanical hinge connection joining the sections at an intermediate position extending in the length of the forming panel. The mechanical connection comprises a hook portion on the first panel received in a slot portion of a second panel and the mechanical connection includes a stop abutment of the hinge connection that is engaged when the panel sections are joined and aligned to form the forming face of the panel. The panel includes a series of brace members extending across the panel section on a rear surface thereof. Each brace member maintains engagement of any stop abutments and provides a rear support of the mechanical connection opposing deflection of the forming face towards the brace member.

In an aspect of the invention, the second panel below the slot includes a downwardly extending web member having a distal end thereof in engagement with the series of brace members to provide the rear support of the mechanical connection.

In a further aspect of the invention, the downwardly extending web member includes a flange or bead portion at the distal end in engagement with the series of braces.

In a further aspect of the invention, the panel includes on either side of the length thereof, downwardly extending side rails and each of the series of brace members extend between and are secured to the side rails.

In a further aspect of the invention, the side rails include an inwardly extending flange portion, and the inwardly extending flange portion supports the brace members at opposite ends thereof.

In a further aspect of the invention, the brace members have an interference fit between said side rails and any of the flange or bead portions maintaining the panel in an assembled configuration.

In a preferred aspect of the invention, the forming panel includes at least a third panel section connected as an intermediary between the first and second panel sections.

In yet a further aspect of the invention, a pair of end rails close opposed ends of the concrete forming panel and are secured to the at least two panel sections.

In yet a further aspect of the invention, the brace members are tubular extrusion members fixedly secured to the side rails.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 2:
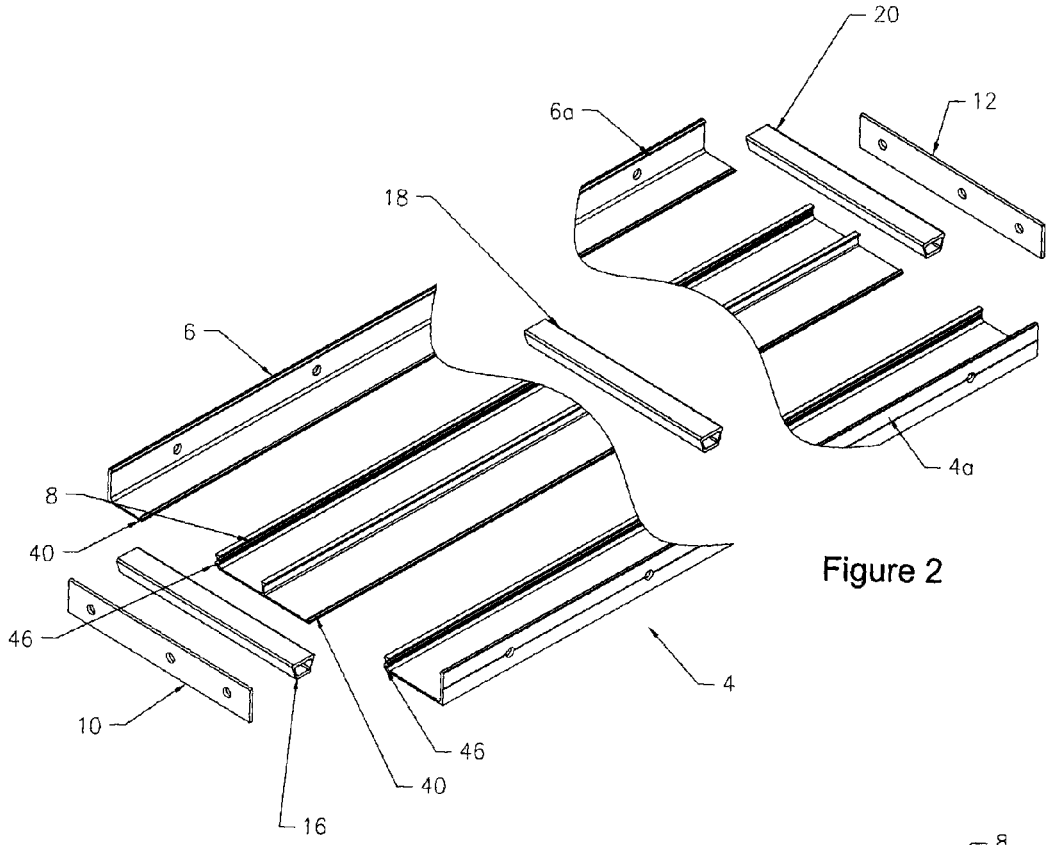
FIG. 2 is an exploded perspective view of the concrete forming panel shown in FIG. 1.
Figure 1:
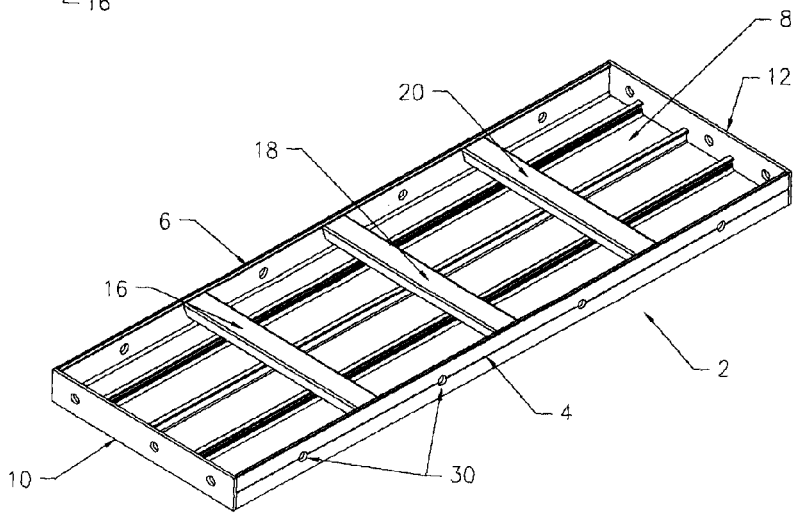
FIG. 1 is a rear perspective view of the concrete forming panel.

The concrete forming panel 2 shown in FIGS. 1 and 2 includes three panel sections; namely side panel section 4, intermediary panel section 8 and side panel section 6. In the embodiment shown, the intermediary panel 8 includes a slot 46 adjacent one edge thereof for receiving the hook 40 of the side panel section 6. The opposite edge of intermediary panel section 8 includes a hook 40 that is received within the slot 46 of the side panel section 4. Details of the hook and slot and their mechanical connection are shown in FIGS. 3 and 4.

The concrete forming panel 2, when the various panel sections are interconnected, has a series of brace members 16, 18 and 20 that engage a rear face of the panel sections and also extend between the side panel sections 4 and 6. These brace members have a slight interference fit with the connected panel sections and the braces maintain the mechanical connections at the front face of the panel in locked engagement and maintain alignment of the panel section to define the planar front face of the forming panel.

The side panel sections 4 and 6 as shown in FIGS. 1 and 2 include integral side edges 4*a* and 6*a* that define the sides of the panel and extend in the length of the panel. The ends of the panel are closed by the end rails 10 and 12. The concrete forming panel 2 includes a plurality of connecting ports 30 provided in the sides of the panel to allow connection to adjacent panels. Preferably these connecting ports include a reinforcing insert to reduce wear of the ports due to fasteners.

Figure 3:
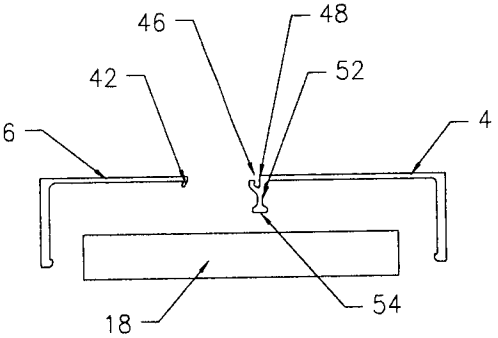
FIG. 3 is a partial exploded assembly view of a concrete forming panel having two panel sections.
Figure 4:
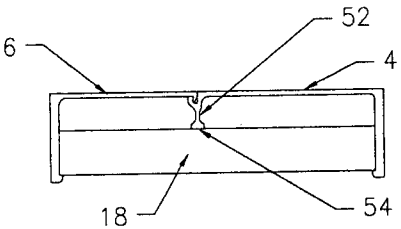
FIG. 4 is a view similar to FIG. 3 with the concrete forming panel in the assembled condition.
Figure 5:
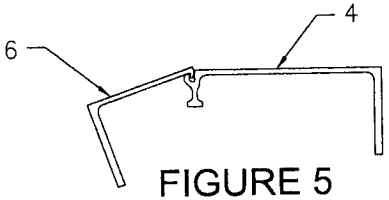
FIGS. 5, 6 and 7 show details of the particular mechanical hinge and the stop abutment that allows the panel to form a planar front face as shown in FIG. 7.
Figure 6:
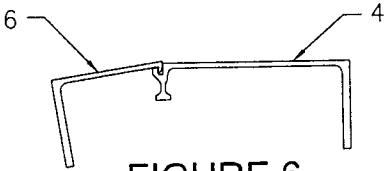
Figure 7:
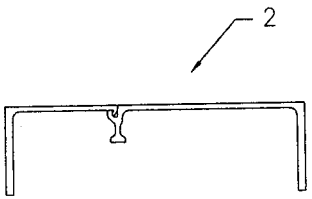

As shown in FIG. 3, the hook 42 is received in the slot 46 and this generally requires it to be moved to the angular position as shown in FIG. 5. In this position, the hook is easily received within the slot 46 and will generally be supported by the upper lip 48, being in other words a stop abutment, at one edge of the side panel 4. The side panel 6 is rotated in a clockwise direction to the planar configuration of the panel as shown in FIG. 7. The side panel section 6 and the side panel section 4 have now aligned and form the planar front face of the concrete forming panel 2.

Beneath the slot 46, the extrusion includes a downwardly extending web member 52 that terminates in a bottom flange or bead portion 54. This web and bottom flange support the slot 46 and, when engaged with the bracing member 18, oppose downward deflection of the top surface of the panel 4 form a stiff load transmitting structure having a top flange, a connecting web and a bottom flange. This can be appreciated from a review of FIG. 4.

This particular support of the side panel section 4 supports the free end of this panel section and also supports the hook 40 of the side panel section 6. In the embodiment of FIGS. 3 through 7, the concrete forming panel has only the two side panel sections 4 and 6 and the one intermediary support provided by the web 52 and the bottom flange or bead 54 is sufficient.

Figure 8:
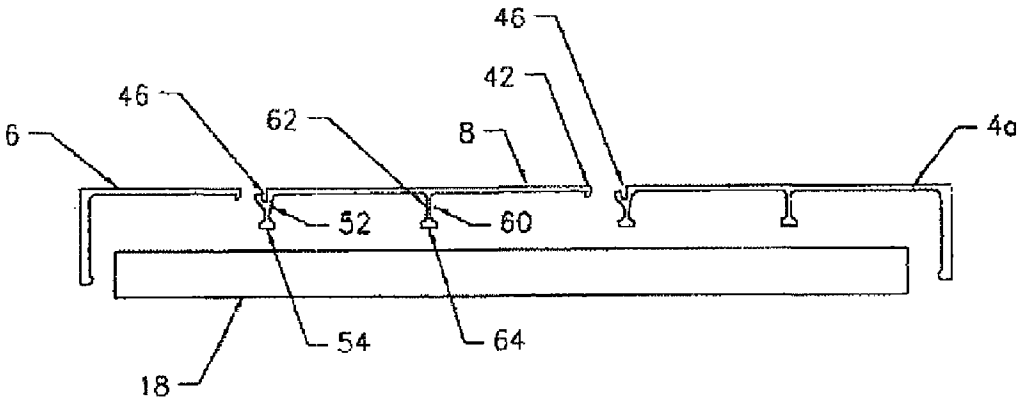
FIG. 8 is a view of a concrete forming panel having first and second outer panel sections and an intermediary panel section.
Figure 9:
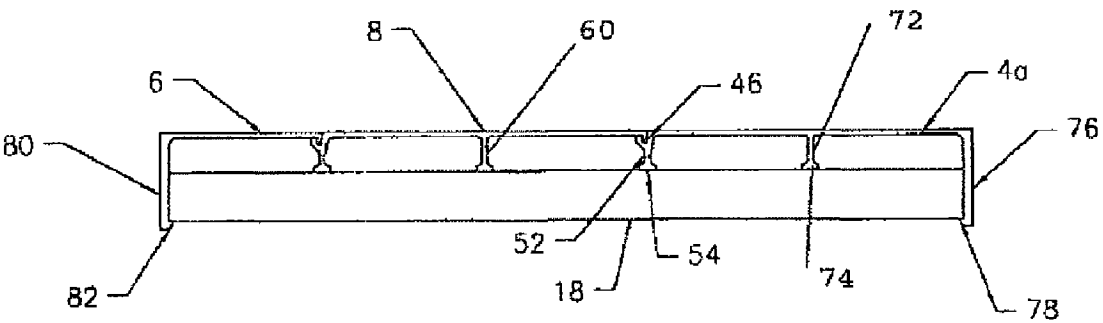
FIG. 9 is the panel of FIG. 8, but in an assembled form.

In the embodiment shown in FIGS. 8 and 9, an additional intermediary panel 8 has been provided having a similar slot 46 adjacent one edge thereof and a hook 42 provided at the opposite longitudinal edge. In this case, the intermediary panel section 8 also includes a central support generally shown as 60 which includes the downwardly extending web 62 and the lower flange or bead portion 64. At the edge of the intermediary panel section 8 is the similar web 52 and lower flange 54 for supporting of the slot 46.

From a review of the assembled panel of FIG. 9, it can be seen that each hook and slot arrangement is directly supported by a downwardly extending web 52 and a flange 54. These members, in combination with the structure for forming of the slot 46, form an I-beam type structure that provides excellent support for the mechanical connection. The intermediary panel section 8 includes the additional support 60 which also engages the bracing member 18. The mechanical connection of intermediary panel section 8 and side panel section 4*a* is also positively supported by a web 52 and a lower flange 54. The modified side panel section 4*a* also includes a downwardly extending web 62 and a bottom flange 64, that provides intermediary support between the side portion 76 and the location of the slot 46 at one edge of the modified panel section 4*a*. With this arrangement, a series of downwardly extending webs and associated flanges engage the various bracing members 16, 18 and 20 as shown in FIGS. 1 and 2, and thus provide a stiff load-transmitting structure to oppose any downward deflection of the front face of the concrete forming panel 2.

Additional braces can be added as required. The side panel sections 4, 4*a* and 6 as shown in the drawings have relatively stiff sides at the edges of the concrete forming panel, and the side members 76 and 80 shown in FIG. 9 serve to retain and secure the bracing member 18. The side member 76 includes an inwardly extending flange 78 that engages and provides support for the base of the bracing member 18. Member 80 includes inwardly extending flange 82 that supports the opposite end of the bracing member 18. Bracing member 18 can be forced into the gap at the rear of the panel and preferably has a slight interference fit with the remaining components to maintain the assembled concrete forming panel in a desired assembly for final securement. The bracing members 16, 18 and 20 are typically welded to the side rails of the panel, namely 76 and 78, as shown in FIG. 9. This arrangement positively maintains the trapezoidal bracing members in the interior of the concrete forming panel at the open rear surface thereof. The end rails 10 and 12 are also preferably welded to the panel sections by a series of tack welds.

Other arrangements for securing of the panel sections to each other can be used, however the use of tack welding simplifies the manufacturing steps and also reduces the cost to manufacture the panel. As can be appreciated, the particular design of the concrete forming panel allows convenient assembly of the various components and these components can generally be maintained in their assembled condition in preparation for welding. The insertion of the bracing members maintains the panel sections in preparation for final securement. Typically the end rails are merely located at the ends of the extrusions and are tack welded in place.

The particular hook and slot arrangement does provide a positive stop face that limits angular movement of adjacent panels, and this stop face assists in defining the planar front face of the concrete forming panel. A very small seam may be visible at this stop face, however this seam is under compression and as such any joining line is quite thin. This improves the finished surface of the concrete. The use of aluminum extrusions also results in the concrete forming panel being easily separated from the concrete and a clean finished surface being defined.

When these concrete forming panels are in place and under load, they are connected to adjacent panels using the various ports 30. Suitable collars can be inserted in the ports, and the panels can be assembled using steel-type connecting pins and wedges. The assembled panels can then be supported by further structural members provided behind the panels. When the panels are loaded due to the concrete load, this load tends to further tighten the mechanical joint and to tighten the securement of the panel sections. The braces positively support the rear surface of the forming face. With this arrangement, the seam at the junction of the hook and slot is under compression and the seam is quite small.

The particular arrangement shown and described allows a series of intermediary panels to be connected between the side panels, and thus panels of different widths are easily produced. The mechanical connection is basically the same, and the number of intermediary supports may be increased. Furthermore, it can be appreciated as shown with respect to the side panel section 4*a*, these side panel sections can also be of different widths and therefore the actual width of the concrete forming panel can easily be modified to meet a particular need of a contractor or a client. With wider concrete forming panels, it may be appropriate to also provide some tack welding of the bracing members to the various support members where they engage or pass over the bracing members.

The panel sections as described extend in the length of the panel; however it is also possible to use shorter panel sections extending in the width. This arrangement is less desirable as the number of seams increase and the bracing would then extend in the length.

It has been found that this concrete forming panel, using the mechanical connection of a plurality of sections, provides a structure which is cost effective to produce and provides excellent characteristics with respect to finish and durability.

The design allows easy modification for building of concrete forming panels in different widths and lengths as may be required.

It is possible to modify the individual panel sections, the bracing members and end rails to provide appropriate support. For example, where loads are higher, the bracing members may be slightly wider or more bracing members provided to provide proper support. The desired trapezoidal shape of the brace members is also convenient for a worker to grasp and is of assistance in assembly and dismantling.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A concrete forming panel comprising at least first and second interlocking panel sections;

the sections having a mechanical hinge connection joining said sections at an intermediate position extending in a length or width of said forming panel;

said mechanical connection comprising a hook portion on said first panel received in a slot portion of said second panel and including a lip that forms a stop abutment of said hinge connection and that is engaged when said panel sections are joined by said hinge connection and aligned to form a planar forming face;

wherein said concrete forming panel includes a series of brace members extending across said panel sections on a rear surface thereof, each brace member maintaining engagement of said stop abutment and providing a rear support of said mechanical connection opposing deflection of said forming face towards said brace member;

wherein said second panel below said slot includes a downwardly extending web member having a bead portion at a distal end thereof, said bead portion being in engagement with said series of brace members to provide said rear support of said mechanical connection;

wherein said first panel includes a downwardly extending first side rail, said second panel includes a downwardly extending second side rail, and each brace member of said series of brace members extends between said first and second side rails; and wherein said first side rail includes an inwardly extending first flange, said second side rail includes an inwardly extending second flange, said first and second flanges extend toward one another, and said first and second flanges support said brace members at opposite ends of said brace members, such that the concrete forming panel exhibits a smooth forming surface.

2. A concrete forming panel as claimed in claim 1 wherein said brace members have an interference fit between said side rails and said bead portion.

3. A concrete forming panel as claimed in claim 1 wherein said forming panel includes a third panel section connected as an intermediary between said first and second panel sections.

4. A concrete forming panel as claimed in claim 2 including a pair of end rails closing opposed ends of said concrete forming panel and secured to said at least two panel sections.

5. A concrete forming panel as claimed in claim 4 wherein said end rails are secured by a series of welds.

6. A concrete forming panel as claimed in claim 4 wherein said brace members are tubular extrusion members fixedly secured to said side rails.

7. A concrete forming panel as claimed in claim 1 wherein a base of said slot of said second panel section and the downwardly extending web member having a bead portion at an end thereof form a stiff load transmitting structure having a top flange, a connecting web and a bottom flange.

8. A concrete forming panel as claimed in claim 6 wherein said tubular members are of a trapezoidal shape cross section.

9. A concrete forming panel as claimed in claim 1 wherein said interlocking panel sections are aluminum extrusions.

10. A concrete forming panel as claimed in claim 1 wherein each brace member of said series of brace members has a first surface in contact with the bead portion, and a second surface, opposite the first surface, partially in contact with each of the first and second flanges.

11. A concrete forming panel as claimed in claim 10, wherein each brace member has an interference fit between the bead portion and the first and second flanges, and said series of brace members lock said first panel and said second panel together while maintaining alignment to define said planar forming face of the concrete forming panel.

* * * * *